US010612788B2

(12) United States Patent
Lah et al.

(10) Patent No.: US 10,612,788 B2
(45) Date of Patent: Apr. 7, 2020

(54) GAS COOKTOP AND GRATE FOR THE GAS COOKTOP

(71) Applicant: Whirlpool Corporation, Benton Harbor, MI (US)

(72) Inventors: Michael C. Lah, Benton Harbor, MI (US); Timothy A. Mayberry, St. Joseph, MI (US); Paul J. Neuman, St. Joseph, MI (US); Nicholas Righetti, Stevensville, MI (US); Anthony S. Roberts, Granger, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 232 days.

(21) Appl. No.: 15/380,506

(22) Filed: Dec. 15, 2016

(65) Prior Publication Data

US 2018/0172279 A1 Jun. 21, 2018

(51) Int. Cl.

| | |
|---|---|
| ***F24C 3/08*** | (2006.01) |
| ***F24C 3/02*** | (2006.01) |
| ***F24C 3/00*** | (2006.01) |
| ***F24C 15/10*** | (2006.01) |

(52) U.S. Cl.

CPC ..... *F24C 3/082* (2013.01); *F24C 3/008* (2013.01); *F24C 3/022* (2013.01); *F24C 15/107* (2013.01)

(58) Field of Classification Search

CPC ..... F24C 15/10; F24C 15/107

See application file for complete search history.

(56) References Cited

U.S. PATENT DOCUMENTS

| | | | |
|---|---|---|---|
| 341,062 | A | 5/1886 | Sheaffer |
| 730,268 | A | 6/1903 | Keller |
| 914,306 | A | 3/1909 | Renkenberger |
| 1,509,526 | A | 9/1924 | O'Dowd |
| D144,093 | S | 3/1946 | Abell |
| D278,306 | S | 4/1985 | McIntosh |
| 5,129,451 | A | 7/1992 | Moir et al. |
| 5,315,983 | A | 5/1994 | Law |
| D389,374 | S | 1/1998 | Miller |
| 5,775,316 | A | 7/1998 | Jones |

(Continued)

OTHER PUBLICATIONS

Uniquely interactive, posted at Luxuryhome.reviewed.com, posted on Jun. 27, 2015, site visited Jan. 31, 2018, <http://luxuryhome.reviewed.com/content/bertazzoni-mas365gasxe-36-inch-gas-range-review>.

*Primary Examiner* — Avinash A Savani
*Assistant Examiner* — Deepak A Deean
(74) *Attorney, Agent, or Firm* — Diederiks & Whitelaw, PLC.

(57) ABSTRACT

A gas cooktop includes a gas burner and a grate for supporting cookware above the gas burner. The grate includes a removable insert having an upper surface and a lower surface and a plurality of tines for supporting the removable insert. When the lower surface of the removable insert is contacting the plurality of tines, the grate supports flat-bottomed cookware on the removable insert at a first height above the gas burner. When the upper surface of the removable insert is contacting the plurality of tines, the grate supports flat-bottomed cookware on the removable insert at a second height above the gas burner, the second height being greater than the first height. When the removable insert is not contacting with the plurality of tines, the grate supports round-bottomed cookware on the plurality of tines.

21 Claims, 5 Drawing Sheets

(56) References Cited

U.S. PATENT DOCUMENTS

| | | | | |
|---|---|---|---|---|
| D401,112 | S | 11/1998 | Miller | |
| D439,110 | S | 3/2001 | Cozzolino | |
| D461,090 | S | 8/2002 | Rummel et al. | |
| D477,177 | S | 7/2003 | Jeong | |
| 6,588,417 | B2 * | 7/2003 | Jones | F24C 15/107 126/214 C |
| 6,712,067 | B1 * | 3/2004 | Barbour | F24C 15/10 126/214 C |
| D489,933 | S | 5/2004 | Rummel et al. | |
| 6,935,330 | B1 * | 8/2005 | Barrero | F24C 15/107 126/214 C |
| D546,119 | S | 7/2007 | Dodge | |
| D564,838 | S | 3/2008 | Shin et al. | |
| D578,823 | S | 10/2008 | Kim | |
| D589,740 | S | 4/2009 | Strayle | |
| D602,738 | S | 10/2009 | Bengton et al. | |
| D610,863 | S | 3/2010 | Kim et al. | |
| D629,638 | S | 12/2010 | Funnell et al. | |
| 7,967,004 | B2 | 6/2011 | Inzaghi | |
| D653,900 | S | 2/2012 | Kim et al. | |
| D685,602 | S | 7/2013 | Lee | |
| D697,756 | S | 1/2014 | Segers et al. | |
| D703,484 | S | 4/2014 | Boo et al. | |
| D721,538 | S | 1/2015 | Kim et al. | |
| D731,845 | S | 6/2015 | Kim et al. | |
| D738,683 | S | 9/2015 | Segers et al. | |
| D767,324 | S | 9/2016 | Funnell, II et al. | |
| D778,099 | S | 2/2017 | Shoemaker et al. | |
| D781,096 | S | 3/2017 | Kim et al. | |
| D782,863 | S | 4/2017 | Kamper et al. | |
| D786,006 | S | 5/2017 | Chung et al. | |
| D786,609 | S | 5/2017 | Cho et al. | |
| D798,108 | S | 9/2017 | Shoemaker et al. | |
| 2004/0089288 | A1 * | 5/2004 | Brown | F24C 15/107 126/214 C |
| 2006/0090743 | A1 | 5/2006 | Hsu | |
| 2009/0044795 | A1 | 2/2009 | Shaffer et al. | |
| 2009/0283091 | A1 * | 11/2009 | Deng | F24C 15/107 126/41 R |
| 2015/0211746 | A1 | 7/2015 | Murdock | |
| 2015/0265097 | A1 | 9/2015 | Poon | |
| 2015/0316269 | A1 | 11/2015 | Dettloff et al. | |
| 2017/0023254 | A1 | 1/2017 | Cadima | |
| 2017/0030585 | A1 | 2/2017 | Mayberry et al. | |
| 2017/0227235 | A1 | 8/2017 | Best et al. | |

* cited by examiner

GAS COOKTOP AND GRATE FOR THE GAS COOKTOP

BACKGROUND OF THE INVENTION

The present invention pertains to cooking appliances and, more particularly, to grates for gas cooktops.

Typically, a gas cooktop includes grates for supporting cookware above the burners of the cooktop. Gas is ignited by these burners to provide the flames used to heat the cookware. As a result, the contents of the cookware are also heated. Generally, the grates are designed to be universal. In other words, the grates are designed to be usable with many different types of cookware rather than one particular type. The grates usually also provide a fixed amount of vertical space between the cookware and the burners, i.e., the spacing is not adjustable.

In view of the above, it would be desirable to provide grates for gas cooktops that are usable with many different types of cookware, as in the prior art, while also being reconfigurable for specific types of cookware and cooking tasks.

SUMMARY OF THE INVENTION

The present invention is directed to a gas cooktop comprising a gas burner and a grate configured to support cookware above the gas burner. The grate includes a removable insert, having an upper surface and a lower surface, and a plurality of tines configured to support the removable insert. When the lower surface of the removable insert is contacting the plurality of tines, the grate is configured to support flat-bottomed cookware on the removable insert at a first height above the gas burner. When the upper surface of the removable insert is contacting the plurality of tines, the grate is configured to support flat-bottomed cookware on the removable insert at a second height above the gas burner, with the second height being greater than the first height. When the insert is removed so as not to be in contact with the plurality of tines, the grate is configured to support round-bottomed cookware on the plurality of tines.

Preferably, the removable insert has a raised portion extending from the lower surface. When the upper surface of the removable insert is contacting the plurality of tines, the grate is configured to support flat-bottomed cookware on the raised portion. The upper surface and the raised portion of the removable insert are flat. In addition, the grate further includes an outer rim. Each of the plurality of tines extends inward and horizontally from the outer rim. When the upper surface of the removable insert is contacting the plurality of tines, the raised portion of the removable insert extends upward relative to the outer rim of the grate.

Preferably, each of the plurality of tines includes a rounded end. When the removable insert is not contacting the plurality of tines, the grate is configured to support round-bottomed cookware on the rounded ends. When the lower surface of the removable insert is contacting the plurality of tines, the lower surface contacts the rounded ends. When the upper surface of the removable insert is contacting the plurality of tines, the upper surface contacts the rounded ends.

Preferably, the removable insert has an outer edge. When the lower surface or the upper surface of the removable insert is contacting the plurality of tines, each of the plurality of tines contacts the outer edge.

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE PREFERRED EMBODIMENTS

Detailed embodiments of the present invention are disclosed herein. However, it is to be understood that the disclosed embodiments are merely exemplary of the invention, which may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to employ the present invention.

In addition, any specific numerical value listed herein includes a margin of error of +/−5%. Accordingly, a length of 1.0 inch includes lengths between 0.95 and 1.05 inches. Similarly, a range of 0.8-1.2 inches includes lengths between 0.76 and 1.26 inches. The term "approximately" increases the margin of error to 10%. Also, as used in connection with the present invention, terms such as "horizontal" and "flat" do not necessarily require that the relevant structure be perfectly horizontal or flat. Instead, these terms are intended to encompass structure that is sufficiently horizontal or flat, for example, so as to function essentially the same as structure that is perfectly horizontal or flat.

Figure 1:
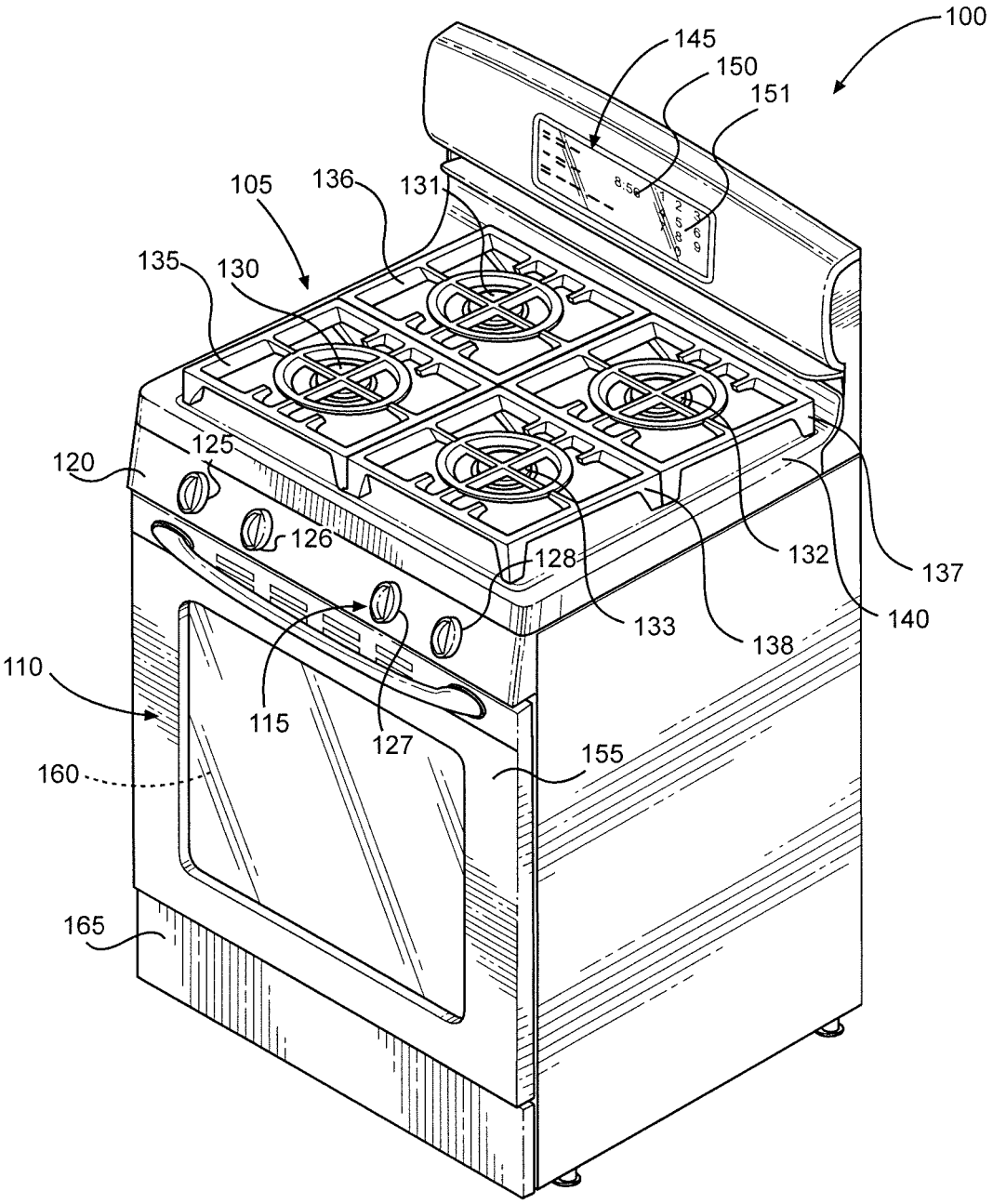
FIG. 1 is a perspective view of a cooking appliance constructed in accordance with the present invention.

With initial reference to FIG. 1, a perspective view of a cooking appliance 100 constructed in accordance with the present invention is provided. Appliance 100 is illustrated as a gas range generally including a cooktop 105 and an oven 110. However, the present invention can be used with other gas cooking appliances, such as stand-alone gas cooktops. Appliance 100 includes a first user interface 115 integrated into a console 120. First user interface 115 enables a user of appliance 100 to control cooktop 105. In particular, user interface 115 includes a plurality of knobs 125-128 for controlling a plurality of burners 130-133 where gas is ignited and burned to provide the heat used to cook food with appliance 100. Grates 135-138 are in direct contact with a cooktop surface 140 through which burners 130-133 extend and are designed to support cookware (not shown) above burners 130-133. A second user interface 145 includes a display 150 and a plurality of buttons 151 for controlling oven 110. Alternatively, a touchscreen display can be used to control oven 110. Appliance 100 further includes a door 155 that allows selective access to an oven cavity 160 and a drawer 165 that provides additional storage.

Figure 2:
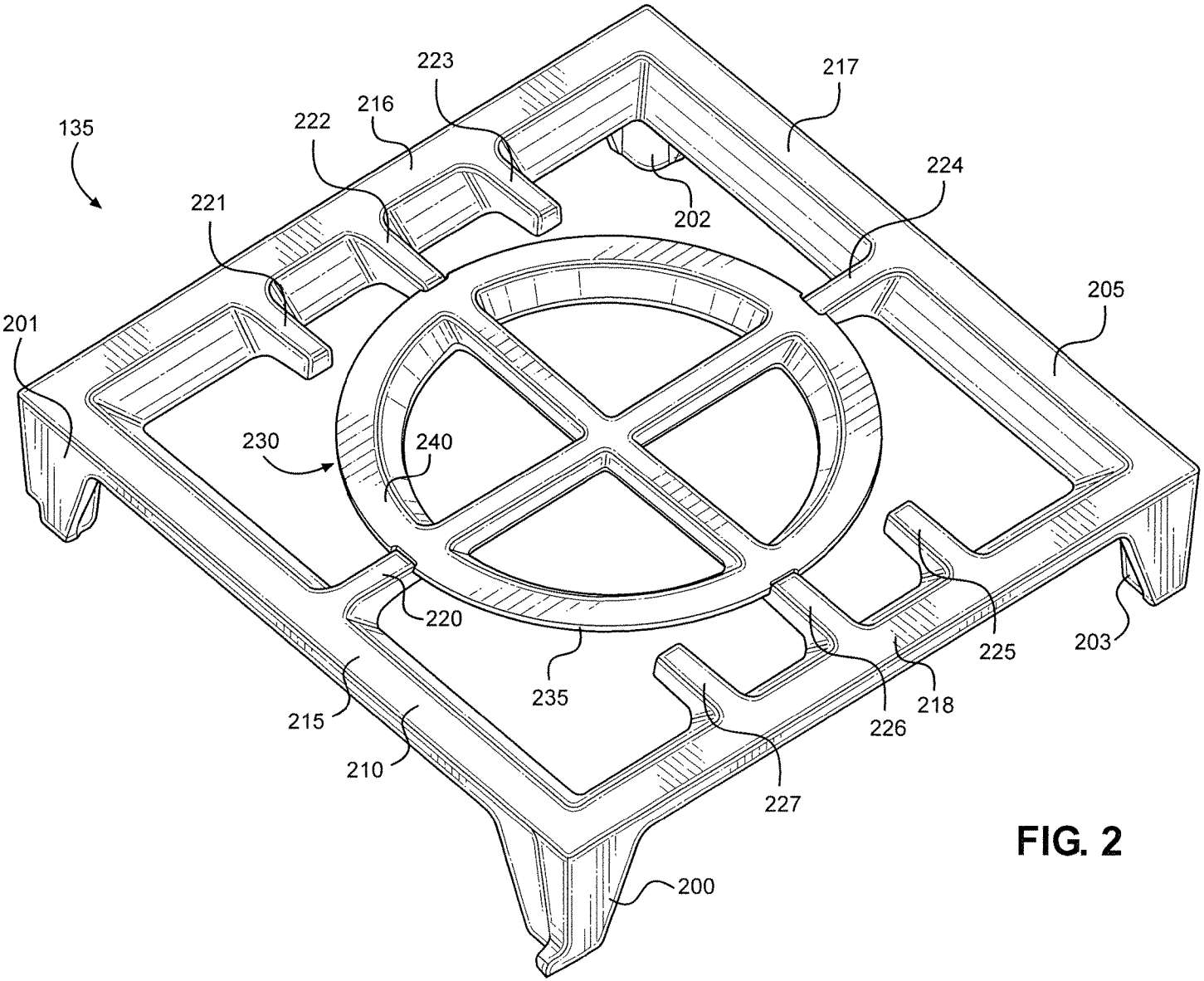
FIG. 2 is a perspective view of a grate of the cooking appliance in a normal mode.

With reference now to FIG. 2, a perspective view of grate 135 is provided. Although the following discussion is directed to grate 135, grates 136-138 are preferably constructed in an identical manner. Grate 135 is shown in a normal mode in FIG. 2. In this mode, grate 135 is configured to support many different types of flat-bottomed cookware (not shown), e.g., pots and pans of various shapes and sizes. In other words, grate 135 is not specifically configured to support any particular type of cookware. Grate 135 includes legs 200-203, each of which directly contacts cooktop surface 140 (not shown) when grate 135 is used with cooktop 105. An upper surface 205 of grate 135 directly contacts cookware placed on grate 135. Legs 200-203 space upper surface 205 from cooktop surface 140 to provide the vertical spacing between burner 130 (not shown) and cookware placed on grate 135.

As known in the art, cooktop grates typically include various horizontally extending supports to help support cookware placed thereon. With respect to grate 135 in particular, grate 135 includes an outer rim 210 connecting legs 200-203. Outer rim 210 generally defines a quadrilateral having four sides 215-218, although grates constructed in accordance with the present invention can take other shapes. Tines 220-227 extend inward from outer rim 210. Tines 220, 222, 224 and 226 directly contact and support a removable insert 230. In particular, tines 220, 222, 224 and 226 directly contact an outer edge 235 of insert 230. Tines 220, 222, 224 and 226 also directly contact a lower surface of insert 230, although this is not visible in FIG. 2. An upper surface 240 of insert 230 is in direct contact with cookware placed on grate 135 in the normal mode. As such, in the normal mode, grate 135 essentially functions as one integral structure despite the removability of insert 230. Outer rim 210, tines 220-227 and insert 230 constitute the horizontally extending supports that support cookware placed on grate 135. However, other variations are possible, such as outer rim 210 being located in a lower plane than tines 220-227 and insert 230.

Figure 3:
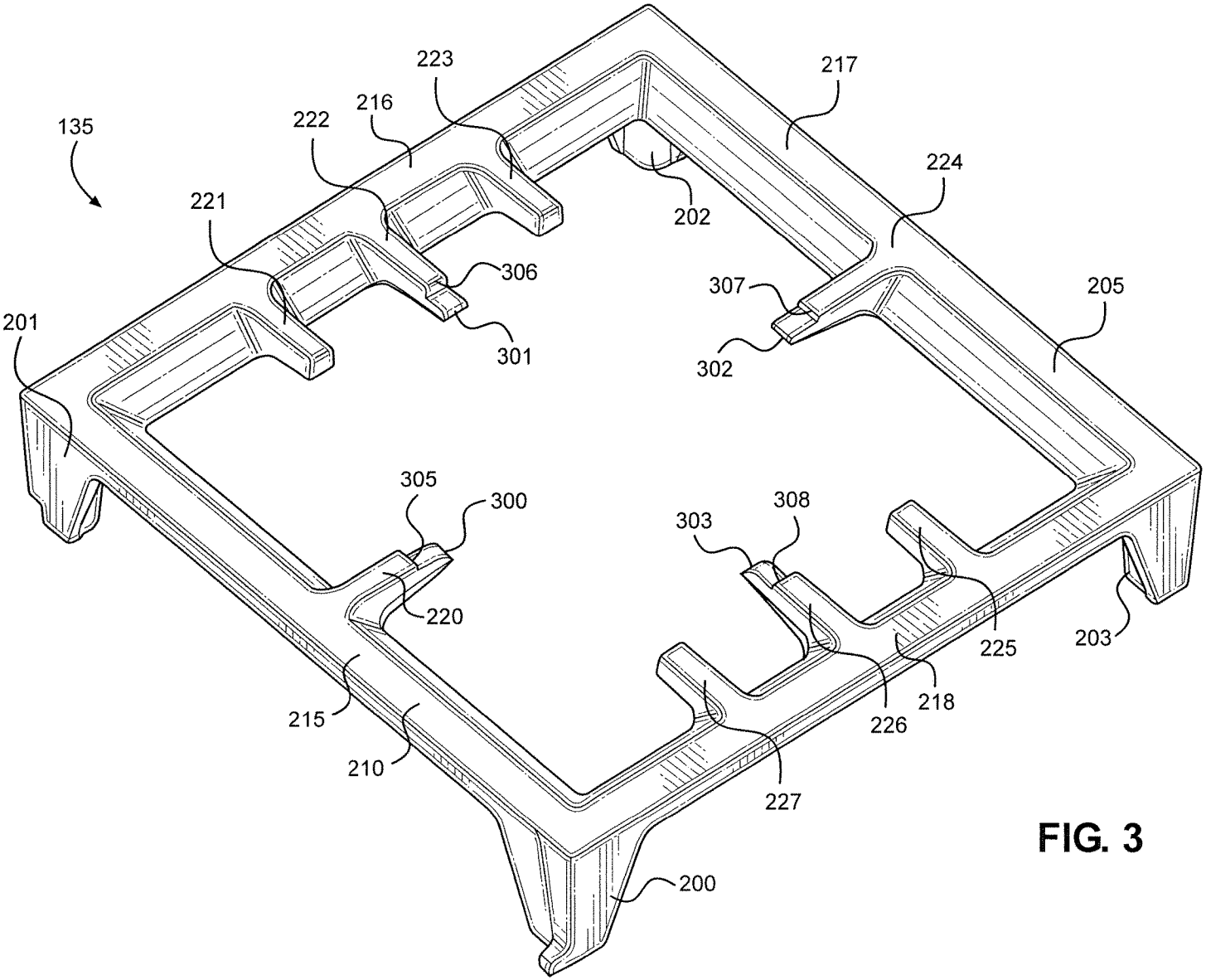
FIG. 3 is a perspective view of the grate in a round bottom utensil cooking mode.

With reference now to FIG. 3, a perspective view of grate 135 is provided with insert 230 removed. In this mode, grate 135 is configured to support round-bottomed cookware or utensils, such as woks, of different sizes (not shown). As shown, tines 220, 222, 224 and 226 have rounded ends 300-303 that are located so as to contact a round bottom utensil placed on grate 135. The curvature of rounded ends 300-303 allows round bottom cookware of different sizes to be supported stably on grate 135. In contrast, when insert 230 is present, the flatness of upper surface 240 of insert 230 prevents round-bottomed cookware from being used with grate 135 because such a utensil would not be stable. In one variation, the ends of various tines can be connected, e.g., tines 221-223 being connected by a curved piece extending at the height of end 301. In any case, in addition to allowing for the use of a round-bottomed wok, the removability of insert 230 means that grate 135 can be easily disassembled for cleaning in a dishwasher, whereas a typical prior art grate can be cumbersome to place in a dishwasher rack due to its shape and mass. In the normal mode, rounded ends 300-303 directly contact a lower surface of insert 230. Also, outer edge 235 of insert 230 directly contacts inner edges 305-308 of tines 220, 222, 224 and 226 to restrain horizontal movement of insert 230.

Figure 4A:
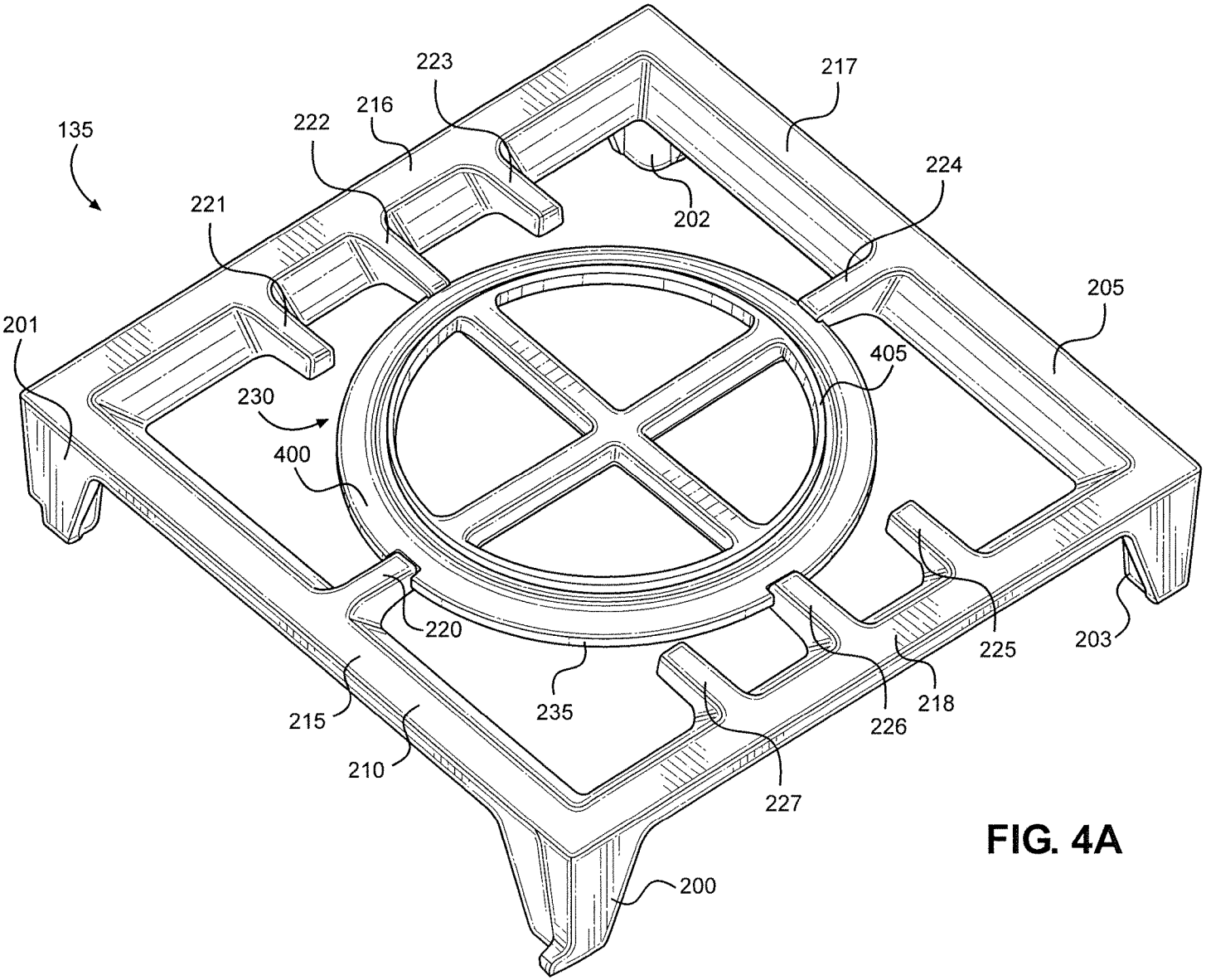
FIG. 4A is a perspective view of the grate in a low temperature, flat bottom utensil cooking mode.
Figure 4B:
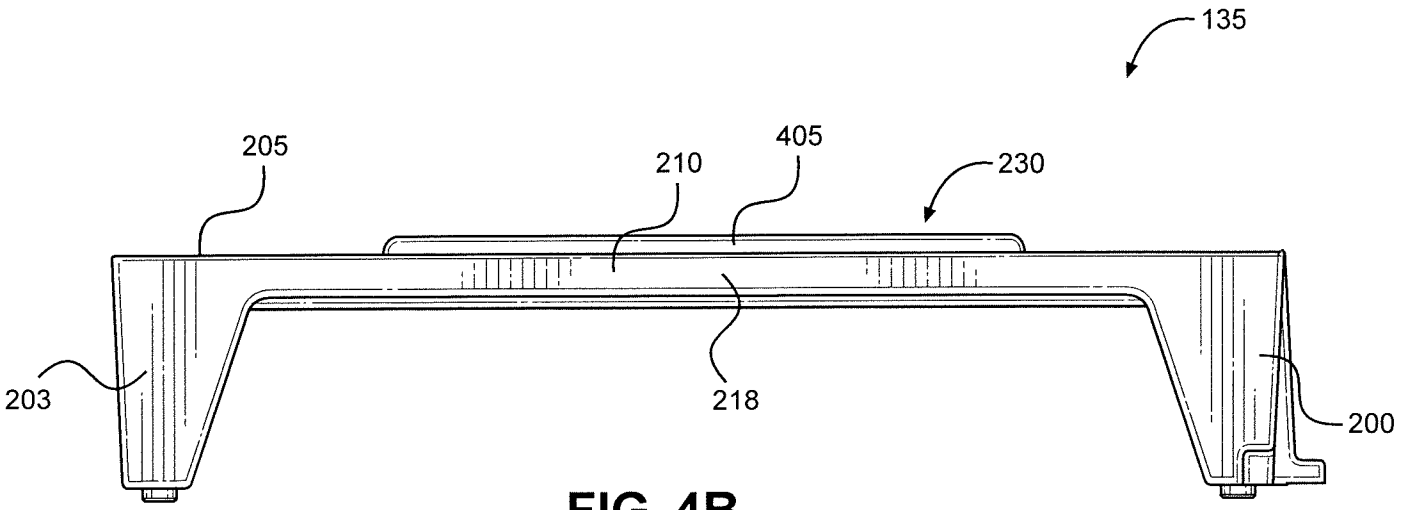
FIG. 4B is a side view of the grate in the low temperature, flat bottom utensil cooking mode.

With reference now to FIGS. 4A and 4B, perspective and side views of grate 135 are provided. Grate 135 is shown in a melt mode, more specifically a low temperature, flat bottom utensil cooking mode, in FIGS. 4A and 4B. As in the normal mode, insert 230 is present. However, insert 230 is now upside down relative to the position shown in FIG. 2. Accordingly, a lower surface 400 of insert 230 is visible. As in the normal mode, outer edge 235 of insert 230 directly contacts inner edges 305-308 of tines 220, 222, 224 and 226. Also, upper surface 240 (not visible) of insert 230 directly contacts rounded ends 300-303 of tines 220, 222, 224 and 226.

In the low temperature, flat bottom utensil cooking mode, when cookware is placed on grate 135, the cookware directly contacts lower surface 400. In particular, the cookware directly contacts a raised portion 405 of insert 230 that extends upward relative to upper surface 205 of grate 135. Preferably, raised portion 405 extends upward by a minimum of 3 mm, and preferably from 3 mm to approximately 20 mm, relative to upper surface 205. This provides additional vertical space between the cookware and burner 130 (not shown). As a result, less heat is applied to the cookware by burner 130 for any given burner setting. Specifically, temperatures below 200° F. are achievable in the low temperature, flat bottom utensil cooking mode, which is beneficial when trying to melt or simmer food. Such temperatures are not typically achievable with prior art grates. The low temperature, flat bottom utensil cooking mode is preferably used in conjunction with relatively smaller flat-bottomed cookware (e.g., cookware having a diameter of 4-6 inches) since raised portion 405 is flat and does not span the full width of grate 135.

In connection with discussing certain features of the present invention, cookware has been described as being flat- or round-bottomed. These terms are not meant to refer to the circumference of the cookware (i.e., the outer wall). Instead, these terms refer to the portion of the cookware that contacts grate 135 (i.e., the bottom) when this portion is viewed in cross section.

Based on the above, it should be readily apparent that the present invention provides grates for gas cooktops that are usable with many different types of cookware while also being reconfigurable for specific types of cookware and cooking tasks. Although described with reference to a preferred embodiment, it should be readily understood that various changes or modifications could be made to the invention without departing from the spirit thereof. For example, some or all of grates 130-133 can be formed integrally with one another such that a single grate is associated with more than one burner and has more than one insert. However, it should also be recognized that not every grate of a cooking appliance constructed in accordance with the present invention need be reconfigurable. In general, the invention is only intended to be limited by the scope of the following claims.

The invention claimed is:

1. A gas cooktop comprising:

a gas burner;

a grate configured to support cookware above the gas burner, the grate including:

a removable insert having an upper surface and a lower surface, wherein the upper surface of the removable insert does not have a plurality of vertical tines configured to support cookware and wherein the lower surface of the removable insert does not have a plurality of vertical tines configured to support cookware; and a plurality of tines configured to support the removable insert;

wherein:

when the lower surface of the removable insert is contacting the plurality of tines, the grate is configured to support flat-bottomed cookware on the removable insert at a first height above the gas burner;

when the upper surface of the removable insert is contacting the plurality of tines, the grate is configured to support flat-bottomed cookware on the removable insert at a second height above the gas burner, the second height being greater than the first height; and when the removable insert is not contacting the plurality of tines, the grate is configured to support round-bottomed cookware on the plurality of tines.

2. The gas cooktop of claim 1, wherein:

the removable insert has a raised portion extending from the lower surface; and when the upper surface of the removable insert is contacting the plurality of tines, the grate is configured to support flat-bottomed cookware on the raised portion.

3. The gas cooktop of claim 2, wherein the upper surface and the raised portion of the removable insert are flat.

4. The gas cooktop of claim 2, wherein:

the grate further includes an outer rim; and each of the plurality of tines extends inward and horizontally from the outer rim.

5. The gas cooktop of claim 4 wherein, when the upper surface of the removable insert is contacting the plurality of tines, the raised portion of the removable insert extends upward relative to the outer rim of the grate.

6. The gas cooktop of claim 4, wherein:

each of the plurality of tines includes a rounded end; and when the removable insert is not contacting the plurality of tines, the grate is configured to support round-bottomed cookware on the rounded ends.

7. The gas cooktop of claim 6, wherein:

when the lower surface of the removable insert is contacting the plurality of tines, the lower surface contacts the rounded ends; and when the upper surface of the removable insert is contacting the plurality of tines, the upper surface contacts the rounded ends.

8. The gas cooktop of claim 4, wherein:

the removable insert has an outer edge; and when the lower surface or the upper surface of the removable insert is contacting the plurality of tines, each of the plurality of tines contacts the outer edge.

9. A grate for supporting cookware above a gas burner of a gas cooktop, the grate comprising:

a removable insert having an upper surface, a lower surface and an annular raised portion extending from the lower surface; and a plurality of tines configured to support the removable insert;

wherein:

when the lower surface of the removable insert is contacting the plurality of tines, the grate is configured to support flat-bottomed cookware on the removable insert at a first height above the gas burner;

when the upper surface of the removable insert is contacting the plurality of tines, the grate is configured to support flat-bottomed cookware on the annular raised portion of the removable insert at a second height above the gas burner, the second height being greater than the first height; and when the removable insert is not contacting the plurality of tines, the grate is configured to support round-bottomed cookware on the plurality of tines.

10. The grate of claim 9, wherein:

when the upper surface of the removable insert is contacting the plurality of tines, the grate is configured to support flat-bottomed cookware on the raised portion.

11. The grate of claim 10, wherein the upper surface and the raised portion of the removable insert are flat.

12. The grate of claim 10, further comprising an outer rim, wherein each of the plurality of tines extends inward and horizontally from the outer rim.

13. The grate of claim 12 wherein, when the upper surface of the removable insert is contacting the plurality of tines, the raised portion of the removable insert extends upward relative to the outer rim of the grate.

14. The grate of claim 12, wherein:

each of the plurality of tines includes a rounded end; and when the removable insert is not contacting the plurality of tines, the grate is configured to support round-bottomed cookware on the rounded ends.

15. The grate of claim 14, wherein:

when the lower surface of the removable insert is contacting the plurality of tines, the lower surface contacts the rounded ends; and when the upper surface of the removable insert is contacting the plurality of tines, the upper surface contacts the rounded ends.

16. The grate of claim 12, wherein:

the removable insert has an outer edge; and when the lower surface or the upper surface of the removable insert is contacting the plurality of tines, each of the plurality of tines contacts the outer edge.

17. The grate of claim 9, wherein:

the annular raised portion extends vertically from the lower surface; and when the upper surface of the removable insert is contacting the plurality of tines, the grate is configured to support flat-bottomed cookware on a flat outer rim of the annular raised portion.

18. The grate of claim 9, wherein the grate is not configured to stably support round-bottomed cookware on the removable insert when the upper surface of the removable insert is contacting the plurality of tines.

19. The grate of claim 9, wherein the second height is greater than the first height by approximately 3-20 mm.

20. A method of reconfiguring a grate for supporting cookware above a gas burner of a gas cooktop, the grate including a removable insert having an upper surface, a lower surface, an annular raised portion extending from the lower surface, and a plurality of tines configured to support the removable insert, the method comprising:

placing the lower surface of the removable insert in contact with the plurality of tines when flat-bottomed cookware is to be supported on the removable insert at a first height above the gas burner;

placing the upper surface of the removable insert in contact with the plurality of tines when flat-bottomed cookware is to be supported on the annular raised portion of the removable insert at a second height above the gas burner, with the second height being greater than the first height; and removing the removable insert from the grate when round-bottomed cookware is to be supported on the plurality of tines.

21. The method of claim 20, wherein:

placing the upper surface of the removable insert in contact with the plurality of tines includes placing the upper surface in contact with the plurality of tines such that flat-bottomed cookware is supportable on the annular raised portion;

the grate further includes an outer rim;

each of the plurality of tines extends inward and horizontally from the outer rim;

each of the plurality of tines includes a rounded end;

removing the removable insert from the grate includes removing the removable insert from the grate such that round-bottomed cookware is supportable on the rounded ends;

placing the lower surface of the removable insert in contact with the plurality of tines includes placing the lower surface in contact with the rounded ends; and placing the upper surface of the removable insert in contact with the plurality of tines includes placing the upper surface in contact with the rounded ends.

* * * * *